US005708238A

United States Patent [19]

Asao et al.

[11] Patent Number: 5,708,238

[45] Date of Patent: Jan. 13, 1998

[54] EXHAUST SILENCING DEVICE

[75] Inventors: Kosuke Asao; Kazuhiro Yasuda; Masashi Koyanagi; Osamu Sato, all of Saitama, Japan

[73] Assignee: Honda Giken Kogyo Kabushiki Kaisha, Tokyo, Japan

[21] Appl. No.: 478,805

[22] Filed: Jun. 7, 1995

[30] Foreign Application Priority Data

Jul. 27, 1994 [JP] Japan ..... 6-175700

[51] Int. Cl.[6] ..... F01N 1/08

[52] U.S. Cl. ..... 181/272; 181/265

[58] Field of Search ..... 181/227, 228, 181/249, 250, 255, 265, 266, 269, 272, 273, 282

[56] References Cited

U.S. PATENT DOCUMENTS 2,985,252 5/1961 Morrish et al. ..... 181/272
3,608,667 9/1971 Foster ..... 181/272
4,023,645 5/1977 Retka et al. ..... 181/255
4,147,230 4/1979 Ormond et al. ..... 181/272 X
4,719,988 1/1988 Kinoushi et al. ..... 181/273

FOREIGN PATENT DOCUMENTS 5-5213 2/1993 Japan .
5-5220 2/1993 Japan .

*Primary Examiner*—Khanh Dang
*Attorney, Agent, or Firm*—Birch, Stewart, Kolasch & Birch, LLP

[57] ABSTRACT

In an exhaust silencing device having inner tubes which are connected to an exhaust pipe connected to an engine and provided with a plurality of through holes, and an outer tube which covers the inner tubes. The occurrence of a whistling sound is prevented while avoiding the use of a sound absorbing material. Recesses are provided on the inner surface of the inner tube, which, together with the outer tube, form an annular expansion chamber.

18 Claims, 6 Drawing Sheets

EXHAUST SILENCING DEVICE

BACKGROUND OF THE INVENTION

1. Field of the Invention

The present invention relates to an exhaust silencing device having inner tubes which are connected to an exhaust pipe and provided with a plurality of through holes, and an outer tube covering the inner tubes.

2. Description of Background Art

An exhaust silencing device has been known, for example, as set forth in Japanese Utility Model (Kokoku) Publication Nos. Hei 5-5213 and Hei 5-5220. According to the exhaust silencing device disclosed in the Japanese Utility Model (Kokoku) Publication No. Hei 5-5213, a sound absorbing material such as glass wool is filled in between the inner tubes and the outer tube for the purpose of deadening an exhaust sound by the sound absorbing function of the sound absorbing material. However, this type of construction for holding the sound absorbing material becomes complicated and results in an increase in the cost.

In Japanese Utility Model (Kokoku) Publication No. Hei 5-5220, no sound absorbing material is filled in a space between the inner tubes and the outer tube. The space is used as an expansion chamber, whereby a shortcoming of the use of the sound absorbing material is obviated. However, production of a high-frequency component sound, a so-called whistling sound, cannot be prevented.

SUMMARY AND OBJECTS OF THE INVENTION

In view of the above-described shortcoming, it is an object of the present invention to provide an exhaust silencing device of simple construction which is capable of preventing an occurrence of the whistling sound while avoiding the use of the sound absorbing material.

To accomplish the above-described object, the exhaust silencing device of the present invention has an inner tube provided with a plurality of through holes which are connected to an exhaust pipe connected to an engine, and an outer tube covering the inner tube. The inner tube forms an annular expansion chamber between the aforementioned inner tube and the outer tube and the inner surface of the inner tube is provided with recesses.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Hereinafter one embodiment of an exhaust silencing device according to the present invention will be explained with reference to the accompanying drawings.

Figure 1:
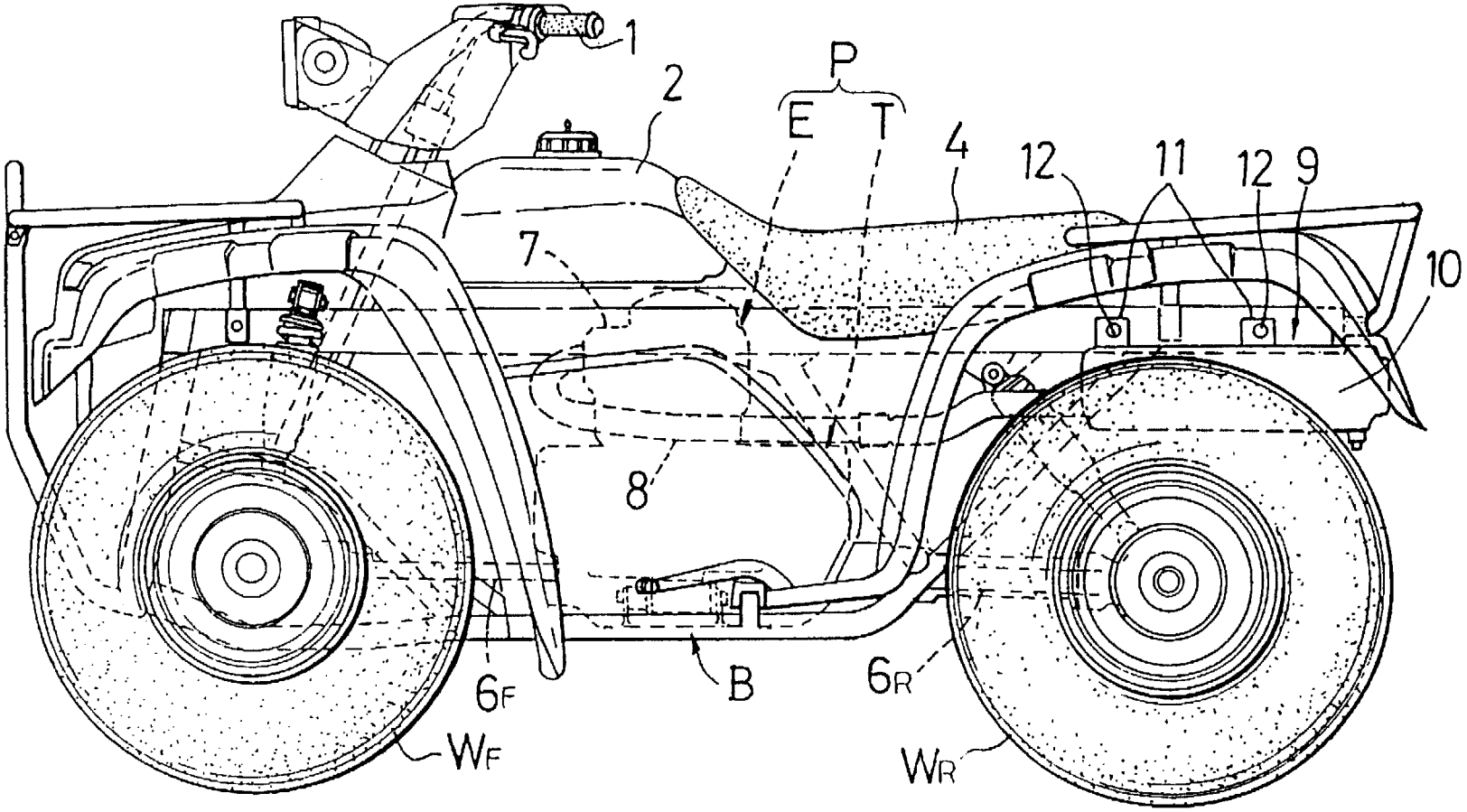
FIG. 1 is a side view of a saddle-type motor vehicle equipped with an exhaust silencing device of the first embodiment.
Figure 2:
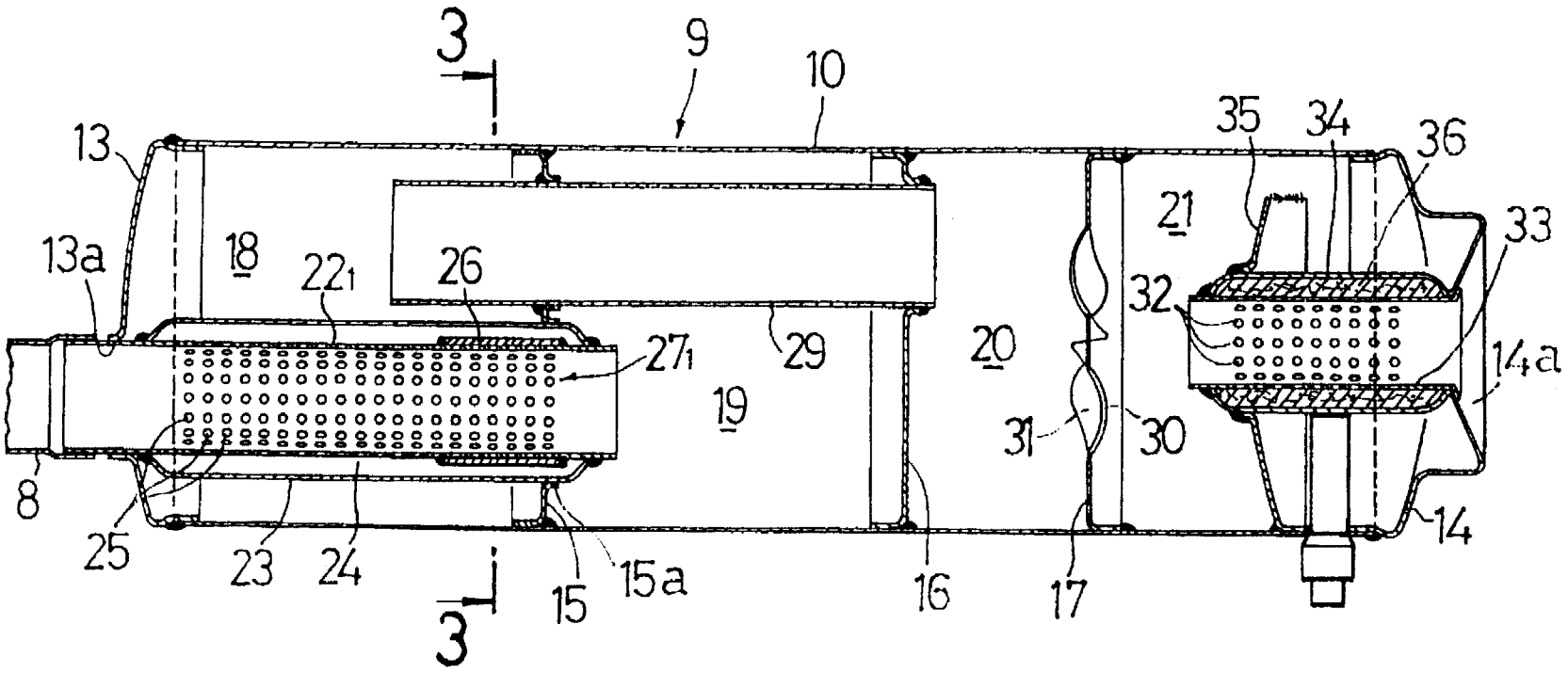
FIG. 2 is a longitudinal sectional view of the exhaust silencing device.
Figure 3:
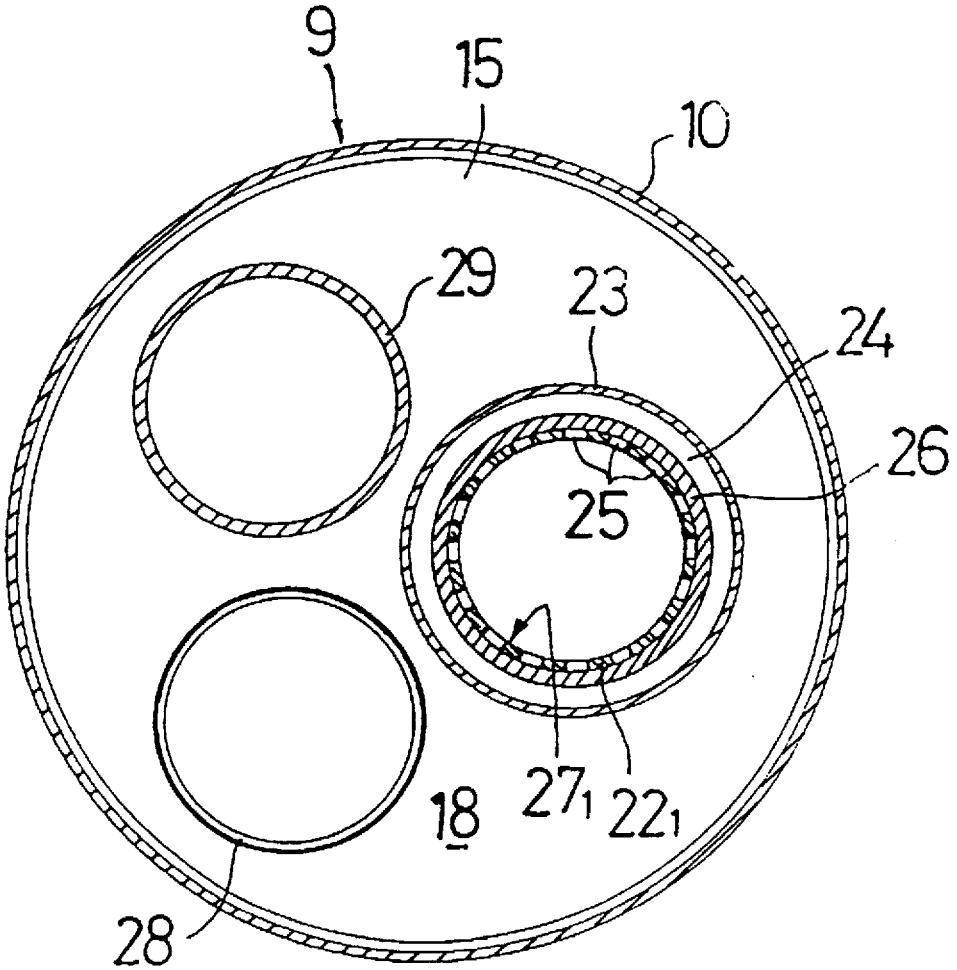
FIG. 3 is a sectional view taken along line 3—3 of FIG. 2.

FIGS. 1 to 3 show one embodiment of the present invention wherein FIG. 1 illustrates a saddle-type motor vehicle such as an all terrain vehicle (ATV) for off-road riding. A pair of right and left front wheels $W_F$ are installed at the front of a vehicle body frame B. A pair of right and left rear wheels We are suspended at the rear of the vehicle body frame B. The wheels $W_F$ and $W_R$ are mounted with balloon type low-pressure tires. A steering handlebar 1, a fuel tank 2, and a straddle-type rider's seat 4 in order of mention from the front are mounted on the upper part of the vehicle body frame.

In the middle portion of the vehicle body frame B, below the fuel tank 2 and the rider's seat 4, a power unit P includes an engine E and a transmission T which are mounted as a unit in a common casing. A driving power from the power unit P is transmitted to the right and left front wheels $W_F$ through a drive shaft $6_F$ extending forwardly from the power unit P, and also to the right and left rear wheels $W_R$ through a drive shaft $6_R$ extending rearwardly from the power unit P.

An exhaust pipe 8 is connected at the front face of the cylinder head 7 of the engine E which extends to the rear around the left side of the engine E and is connected to an exhaust silencing device 9 which is fixedly supported at the rear part of the vehicle body frame B.

In FIGS. 2 and 3, the exhaust silencing device 9 is provided with a cylindrical casing 10. As shown in FIG. 1, a pair of brackets 11, 11 are mounted on the casing 10 and fixedly supported on the rear part of the vehicle body frame B by screw members 12, 12.

The front end of the casing 10 is closed with a front end wall 13. A rear end wall 14 having an exhaust port **14*a* which is flared backwards, is provided at the rear end of the casing 10. Therefore, the interior of the casing 10 is separated by partition walls 15, 16 and 17 secured on the inner surface of the casing 10 which are spaced in the axial direction. The casing is separated into a first chamber 18 between the front end wall 13 and the partition wall 15, a second chamber 19 between the partition walls 15 and 16, a third chamber 20 between the partition walls 16 and 17, and a fourth chamber 21 between the partition wall 17 and the rear end wall 14**.

A tube section **13*a* connected in a gas tight manner through to the front end of the inner tube $22_1$ which is in parallel with the casing 10 is provided in a position offset from the axial line of the front end wall 13. The front end of the inner tube $22_1$ protruding forwards from the tube section 13*a* is securely connected to the exhaust pipe 8, while the rear end of the inner tube $22_1$ extends into the interior of the second chamber 19**.

In the casing 10, the inner tube $22_1$ is coaxially covered with the outer tube 23. The contracted front end of the outer tube 23 is welded to the whole circumference of the outer surface of the inner tube $22_1$ in the vicinity of the front end wall 13, while the contracted rear end of the outer tube 23 is welded to the whole circumference of the outer surface of the inner tube $22_1$ in the second chamber 19. Therefore, an annular expansion chamber 24 is formed between the inner tube $22_1$ and the outer tube 23. A tube section 15*a* protrudes in a gas tight condition into the second chamber 19 through the outer tube 23 on the partition wall 15.

In a part corresponding to the expansion chamber 24 of the inner tube 22*l* is provided a plurality of through holes 25 at a space in circumferential and axial directions. Of these through holes 25, through holes on the rear side near the second chamber 19 are closed with the cylindrical cover tube 26 coaxially enclosing the inner tube $22_1$. The front and rear ends of the cover tube 26 are connected by welding to the whole circumference of the outer surface of the inner tube $22_1$. The outer end of the plurality of through holes 25 provided in the portion near the rear end of the inner tube $22_1$ is closed by the cover tube 26, thereby forming recesses $27_1$ on the inner surface of the rear portion of the inner tube $22_1$.

In a position offset from the axial line of the casing 10, a relatively short first connecting tube 28 is fixedly mounted through the partition wall 15 in parallel with the outer tube 23. Thus, the second chamber 19 is connected with the first chamber 18 by the first connecting tube 28. Also in a position offset from the axial line of the casing 10, a relatively long second connecting tube 29 which is in parallel with the first connecting tube 28 is fixedly mounted through the partition walls 15 and 16, opening at the front end to the first chamber 18 and also opening at the rear end to the third chamber 20.

A plurality of louvers 30 are provided at the central portion of the partition wall 16 to form a communicating hole 31 therebetween.

In the fourth chamber 21, the rear end of a rear inner tube 33 having a plurality of through holes 32 is connected to the exhaust port 14*a* on the same axis as the casing 10. The contracted front end of a rear outer tube 34 coaxially covering the rear inner tube 33 is welded to the whole outer peripheral surface of the rear end portion of the rear inner tube 33. The contracted rear end of the rear outer tube 34 is welded to the whole outer peripheral surface of the rear end portion of the rear inner tube 33. In addition, a plurality of legs 35 are fixedly installed in positions at spaces in the circumferential direction of the rear outer tube 34. The legs 35 are securely installed to the inner surface of the casing 10. A sound absorbing material 36 such as glass wool is filled between the rear inner tube 32 and the rear outer tube 34.

At the rear end of the casing 10 is fixedly attached an insertion tube 37 protruding into the fourth chamber 21. A sensor (not shown) for detecting an exhaust temperature is inserted in the insertion tube 37.

Next, operation of the first embodiment will be explained. The exhaust gas from the exhaust pipe 8 passes through in the inner tube $22_1$, being led into the second chamber 19, from which the exhaust gas is fed back into the first chamber 18 through the first connecting tube 28. Then, the exhaust gas is introduced from the first chamber 18 into the third chamber 20 by the second connecting tube 29, from which the exhaust gas then passes through the louvers 30, becoming a swirl flow. After being led from the third chamber 20 into the fourth chamber 21, the exhaust gas is discharged out through the rear inner tube 32 and the exhaust port 14*a*.

In the exhaust silencing device 9 of the above-described construction, the exhaust gas is led into the inner tube $22_1$ communicating with the expansion chamber 24 through a plurality of through holes 25, thereby accomplishing the deadening of exhaust noise by the expansion of the exhaust gas. In such a construction, the occurrence of a resonance effect producing a whistling sound is unavoidable. It has been confirmed experimentally that, because of the provision of the recesses $27_1$ on the inner surface of the rear end portion of the inner tube $22_1$, the exhaust gas flow is made turbulent to cancel the resonance effect, thereby enabling to prevent the occurrence of the whistling sound.

Therefore, there is no necessity to fill a sound absorbing material between the inner tube $22_1$ and the outer tube 23, thereby obviating a disadvantage accompanied by the filling of the sound absorbing material, that is, an increase in cost and further to reduce the sound of a high-frequency component.

In addition, since the recesses $27_1$ are formed by partly covering the inner tube $22_1$ by the cover tube 26, the recesses $27_1$ can easily be formed on the inner surface of the inner tube $22_1$.

Figure 4:
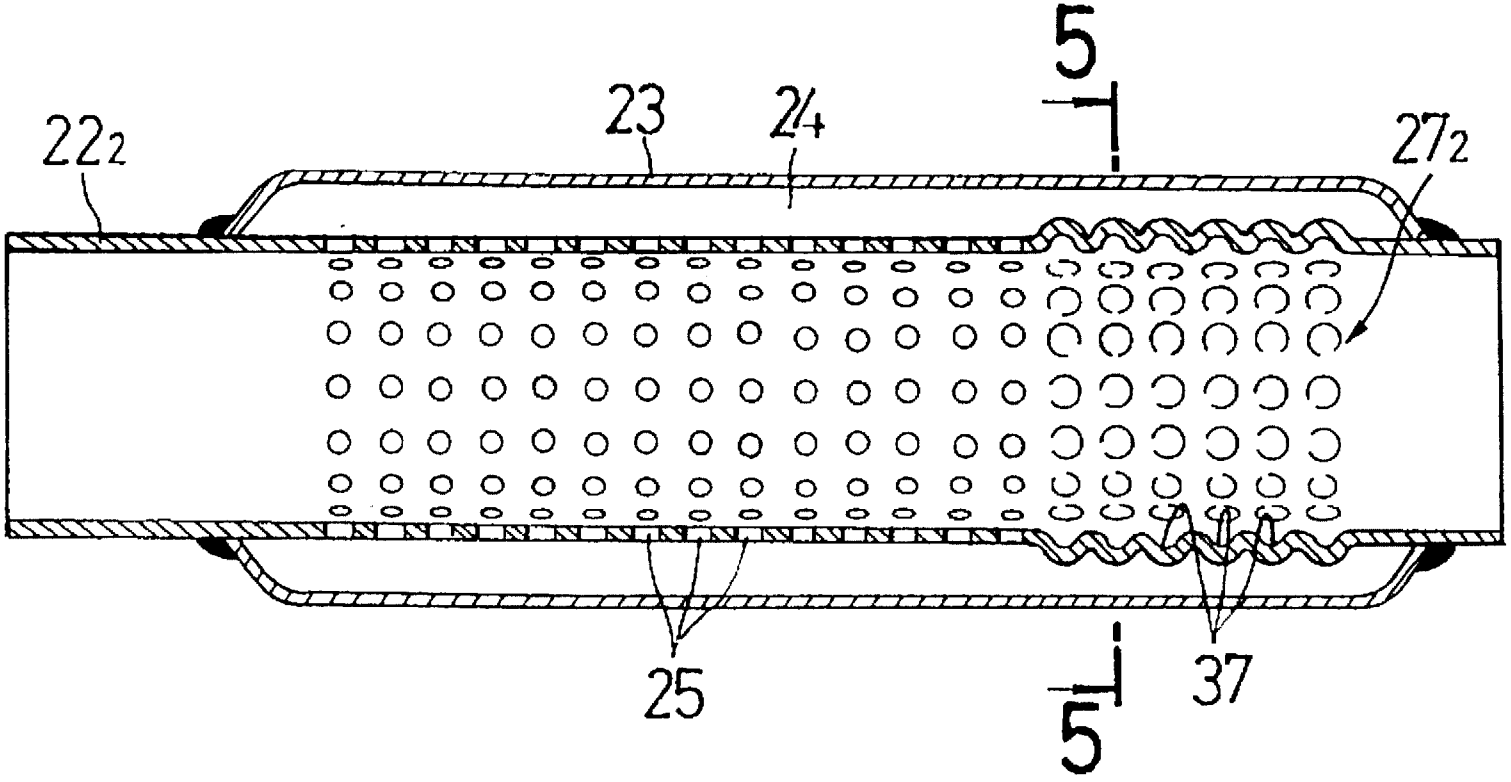
FIG. 4 is a longitudinal sectional view of a major portion of the exhaust silencing device of the second embodiment.
Figure 5:
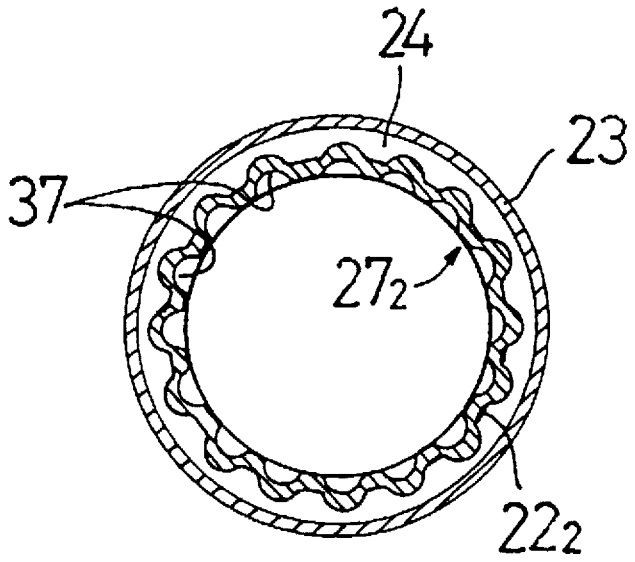
FIG. 5 is a sectional view taken along line 5—5 of FIG. 4.
Figure 6:
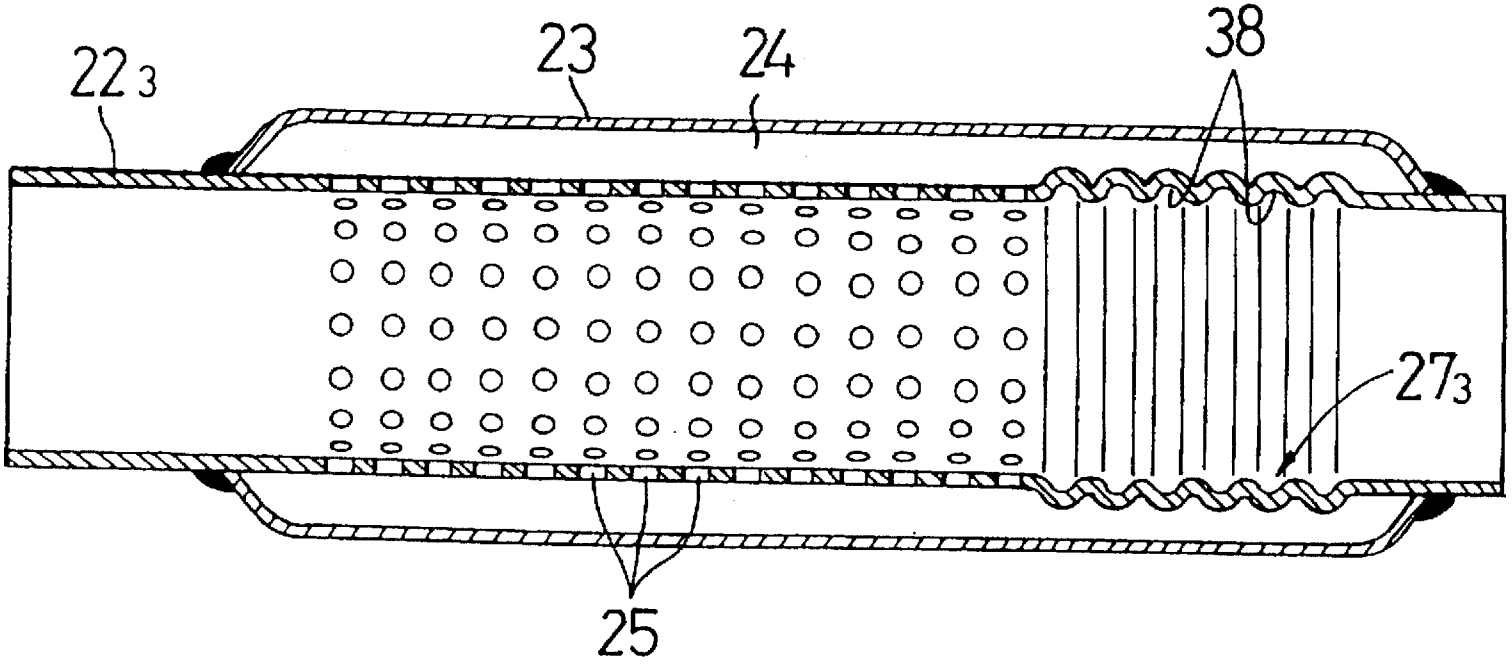
FIG. 6 is a sectional view corresponding to FIG. 4 of the third embodiment.

It is to be noticed that, as shown in FIGS. 4 and 5 as the second embodiment of the present invention, a plurality of recesses swelling outwards may be provided at a space in the circumferential and axial directions in a portion near the rear end of the inner tube $22_2$ which, together with the outer tube 23, forms the expansion chamber 24 as the second embodiment of the present invention as shown in FIGS. 4 and 5, thereby providing the inner surface of the inner tube $22_2$ with recesses $27_2$, or that, as shown in FIG. 6 as the third embodiment of the present invention, a plurality of annular recesses 38 swelling outwards may be provided at a space in the axial direction, in the rear end portion of an inner tube $22_3$ which, together with the outer tube 23, forms the expansion chamber 24, thereby providing the inner surface of the inner tube $22_3$ with recesses $27_3$.

The preferred embodiments of the present invention have been described in detail; however, the present invention should not be limited to the above-described embodiments and various changes and modifications in design are possible within the scope of the present invention stated in claims.

For example, the recesses $27_1$ to $27_3$ may be provided in the front end portion of the inner tubes $22_1$ to $22_3$, and the location of these recesses $27_1$ to $27_3$ is not limited.

According to the present invention, as described above, in the exhaust silencing device having the inner tubes which are connected to the exhaust pipe connected to the engine and are provided with a plurality of through holes, and the outer tube which covers the inner tubes, the recesses are provided on the inner surface of the inner tube which, together with the outer tube, forms the annular expansion chamber. Therefore, the sound absorbing material is dispensed with and the provision of the recesses cancels the resonance effect by disturbing the exhaust gas flow, to thereby prevent the occurrence of the whistling sound.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust silencing device comprising:

an inner tube operatively connected to an exhaust pipe adapted to be connected to an engine, said inner tube having a sidewall with a plurality of through holes passing therethrough which allow exhaust gasses to pass therethrough;

a cover for covering a plurality of said through holes to prevent exhaust gasses from passing therethrough; and an outer tube surrounding a portion of said inner tube, said inner tube and said outer tube together forming an annular expansion chamber therebetween.

2. The exhaust silencing device according to claim 1, wherein said cover includes a cover tube surrounding a portion of said inner tube.

3. The exhaust silencing device according to claim 1, wherein said outer tube is welded around the inner tube.

4. The exhaust silencing device according to claim 3, wherein said outer tube is tapered to fit around an outer surface of said inner tube.

5. The exhaust silencing device according to claim 1, and further including a casing enclosing at least a portion of each of said inner tube and said outer tube therein.

6. The exhaust silencing device according to claim 5, wherein said casing includes at least one partition wall for dividing said casing into a plurality of spaced-apart chambers.

7. The exhaust silencing device according to claim 6, wherein three partition walls are disposed within said casing to form four chambers therein.

8. The exhaust silencing device according to claim 6, and further including a louver disposed in said at least one partition wall separating said plurality of spaced-apart chambers.

9. The exhaust silencing device according to claim 1, wherein said inner tube is disposed at an upstream end of said exhaust silencing device, and an interior tube is disposed at a downstream end of said exhaust silencing device.

10. An exhaust silencing device comprising:

a casing defining a chamber disposed therein;

at least one inner conduit mounted within said casing with an upstream end of said at least one inner conduit passing through an endwall of said casing and a downstream end being disposed within said casing, the inner conduit having a sidewall with a plurality of through holes passing therethrough which allow exhaust gasses to pass therethrough;

a cover for covering a plurality of said through holes to prevent exhaust gasses from passing therethrough; and an outer conduit surrounding a portion of said inner conduit, said inner conduit and said outer conduit together forming an annular expansion chamber therebetween.

11. The exhaust silencing device according to claim 10, wherein said cover includes a cover tube surrounding a portion of said inner conduit.

12. The exhaust silencing device according to claim 10, wherein said outer conduit is welded to the inner conduit.

13. The exhaust silencing device according to claim 12, wherein said outer conduit is tapered to fit around an outer surface of said inner conduit.

14. The exhaust silencing device according to claim 10, wherein said casing includes at least one partition wall for dividing said casing into a plurality of spaced-apart chambers.

15. The exhaust silencing device according to claim 14, wherein three partition walls are disposed within said casing to form four chambers therein.

16. The exhaust silencing device according to claim 14, and further including a louver disposed in said at least one partition wall separating said plurality of spaced-apart chambers.

17. The exhaust silencing device according to claim 10, further including an interior tube disposed at least partially within said casing and located at a downstream end of said exhaust silencing device.

18. An exhaust silencing device comprising:

an inner tube operatively connected to an exhaust pipe adapted to be connected to an engine, said inner tube having a sidewall with a plurality of through-holes passing therethrough;

a cover tube surrounding a portion of said inner tube for closing off a plurality of said through-holes in said inner tube to thereby form a plurality of recesses on an inner surface of said sidewall; and an outer tube surrounding said cover tube and a portion of said inner tube, said inner tube and said outer tube together forming an annular expansion chamber therebetween.

* * * * *